United States Patent [19]

Sieurin et al.

[11] 4,154,074

[45] May 15, 1979

[54] ROLL STAND FOR A ROD OR BAR ROLLING MILL

[75] Inventors: Donald Sieurin, Schrewsbury, Mass.; Charles S. Mercer, Little Compton, R.I.; Richard J. Reardon, Morningdale, Mass.

[73] Assignee: Morgan Construction Company, Worcester, Mass.

[21] Appl. No.: 881,584

[22] Filed: Feb. 27, 1978

[51] Int. Cl.[2] ..... B21B 31/18; B21B 31/24

[52] U.S. Cl. ..... 72/21; 72/247; 72/239; 72/248

[58] Field of Search ..... 72/247, 239, 238, 237, 72/21

[56] References Cited

U.S. PATENT DOCUMENTS

| | | | |
|---|---|---|---|
| 1,891,579 | 12/1932 | Schreck | 72/247 X |
| 2,575,231 | 11/1951 | O'Malley | 72/247 X |
| 3,162,070 | 12/1964 | Morgan et al. | 72/247 |

*Primary Examiner*—Milton S. Mehr

*Attorney, Agent, or Firm*—Thompson, Birch, Gauthier & Samuels

[57] ABSTRACT

A horizontal or vertical roll stand for a rod or bar rolling mill comprising a pair of work rolls having a plurality of grooves spaced axially along the surfaces thereof, each work roll being journalled between bearings contained in bearing chocks, with the bearings being adapted to accommodate axial adjustment of the work rolls in relation to the bearing chocks. The bearing chocks are supported in a housing with the work rolls in parallel relationship and with the grooves defining a plurality of roll passes. An axial roll adjustment means is associated with each work roll. Both of the axial adjustment means are driven by a common axial adjustment drive. A clutch is connected between one axial adjustment means and the axial adjustment drive. When engaged, the clutch permits the axial adjustment drive to operate through both axial adjustment means, thus axially adjusting both work rolls simultaneously. When the clutch is disengaged, the axial adjustment drive operates through only one axial adjustment means, with the result that one work roll is adjusted axially in relation to the other work roll. The work rolls are additionally acted upon by roll parting adjustment means driven by a common parting adjustment drive.

On vertical roll stands, the axial adjustment drive and the parting adjustment drive are supported on a platform overlying the roll housing. Both drives are connected to their respective adjustment means via couplings which are separated and assembled in response to vertical movement of the platform between a lowered operative position supported on the roll housing and an inoperative position spaced vertically thereabove.

9 Claims, 14 Drawing Figures

ROLL STAND FOR A ROD OR BAR ROLLING MILL

BACKGROUND OF THE INVENTION

1. Field of the Invention

This invention relates generally to rolling mills for rolling products such as rods or bars. The invention is concerned in particular with a rolling mill roll stand incorporating improved means for adjusting the operative positions of the work rolls in relation to each other as well as in relation to the mill pass line.

2. Description of the Prior Art

In a rolling mill of the above-described type, for example a single strand bar mill, a plurality of vertical and horizontal roll stands are arranged in an alternating sequence along the rolling line. Each roll stand has a roll housing containing a pair of work rolls. The work rolls have multiple grooves defining a plurality of roll passes. When an active roll pass becomes worn, the rolling operation is temporarily interrupted and another roll pass is aligned with the mill pass line by shifting the roll housing in the direction of the roll axes. Thereafter, as rolling continues, the cross-section of the rolled product is monitored closely. If prescribed tolerances are not being achieved, then further roll adjustments are made. These adjustments can comprise one or more of the following: an axial shifting of one roll relative to the other roll in order to bring the roll grooves of an active roll pass into proper alignment with each other; an axial shifting of both rolls in order to adjust the alignment of an active roll pass in relation to the mill pass line (as defined by the guides on the roll housings); a symmetrical lateral shifting of both work rolls in order to adjust the spacing or "parting" therebetween. These adjustments are extremely precise. For example, axial roll adjustments are usually on the order of ±0.002"-0.125".

The above-mentioned axial roll adjustments are conventionally made manually at each roll stand by employing mechanisms of the type shown in U.S. Pat. No. 3,003,836. However, experience has indicated that it is extremely difficult for operating personnel to make precise adjustments at the rolling line where the environment is characterized by noise, coolant sprays, equipment vibrations, etc. Consequently, the reaction time of operating personnel is frequently too slow, and the resulting adjustments often lack precision. This in turn results in wasteful production of off-gauge unacceptable product.

A further drawback which is particularly characteristic of conventional vertical roll stands is that for various roll adjustment mechanisms and their associated drives are mounted directly on the roll housing in a manner which unduly complicates shifting of the housing away from and back onto the rolling line when roll changes are required.

SUMMARY OF THE INVENTION

A general object of the present invention is the provision of a rolling mill roll stand which obviates the above-noted problems by incorporating improved means for adjusting the operative positions of the work rolls.

Another object of the present invention is the provision of a rolling mill roll stand incorporating axial roll adjustment means operable from a location remote from the rolling line, for example from a centrally located control pulpit.

Still another object of the present invention is the provision of an axial roll adjustment means which may be operated remotely, and which has the capability either of axially adjusting one roll relative to the other roll or of axially adjusting both rolls simultaneously.

A further object of the present invention is the provision of a vertical roll stand wherein the work rolls are acted upon by both axial adjustment means and roll parting adjustment means, with the drives for both adjustment means being mounted on a platform which is separate from the roll housing and readily movable to an inoperative position, thereby permitting the housing to be shifted away from and back onto the rolling line when making roll changes.

In a preferred embodiment to be hereinafter described in greater detail, these as well as other objects and advantages are achieved by providing a rolling mill roll stand comprising a pair of work rolls having a plurality of grooves spaced axially along the surfaces thereof, each work roll being journalled between bearings contained in bearing chocks, with the bearings being adapted to accommodate axial adjustment of the work rolls in relation to the bearing chocks. The bearing chocks are supported in a housing with the work rolls in parallel relationship and with the roll grooves defining a plurality of roll passes. An axial roll adjustment means is associated with one bearing chock of each roll. Both axial adjustment means are driven by a common axial adjustment drive. A clutch is connected between one axial adjustment means and the axial adjustment drive. When engaged, the clutch permits the axial adjustment drive to operate through both axial adjustment means, thereby axially adjusting both work rolls in relation to the mill pass line. When the clutch is disengaged, the axial adjustment drive operates through only one axial adjustment means, with the result that one work roll is adjusted axially in relation to the other work roll. The axial adjustment drive and the clutch associated therewith are operable from a location which is remote from the rolling line, for example from a centrally located control pulpit. Both axial adjustment means have sensors associated therewith. The sensors emit electrical signals representative of the adjustments being made to the work rolls. These signals may also be monitored at the control pulpit, where product tolerances are also being remotely monitored.

The roll stand preferably also includes a parting adjustment means associated with each work roll for imparting lateral adjustments thereto. The parting adjustment means for both work rolls are connected to a common parting adjustment drive which is also remotely operable from the same control pulpit.

Preferably, the roll housing is located along the rolling line by a support means incorporating a housing adjustment means for moving the roll housing in the direction of the roll axes in order to align different roll passes with the mill pass line.

To the extent just described, the invention is applicable to both horizontal and vertical roll stands. However, in vertical roll stands, the upper roll ends preferably protrude above the uppermost bearing chocks. The rolls are driven by an overlying mill drive having depending telescoping spindles which are detachably connected to the upper roll ends by vertically removable coupling boxes.

A platform is preferably located between the housing of each vertical roll stand and the overlying mill drive. The axial adjustment drive and the parting adjustment drive are carried on said platform, and means including separable couplings provide the drive connection between the drives and their respective adjustment means. An elevating means is employed to move the platform vertically between a lowered operative position supported on the housing and a raised inoperative position spaced thereabove. The aforesaid couplings separate in response to vertical movement of the platform between its operative and inoperative positions. With the platform in its raised inoperative position, the housing may be moved laterally away from and back onto the rolling line when making roll changes.

These and other objects and advantageous features will be more clearly understood from the following description and the accompanying drawings, both of which refer to a preferred but non-limiting embodiment of the invention.

DESCRIPTION OF ILLUSTRATED EMBODIMENT

Figure 1:
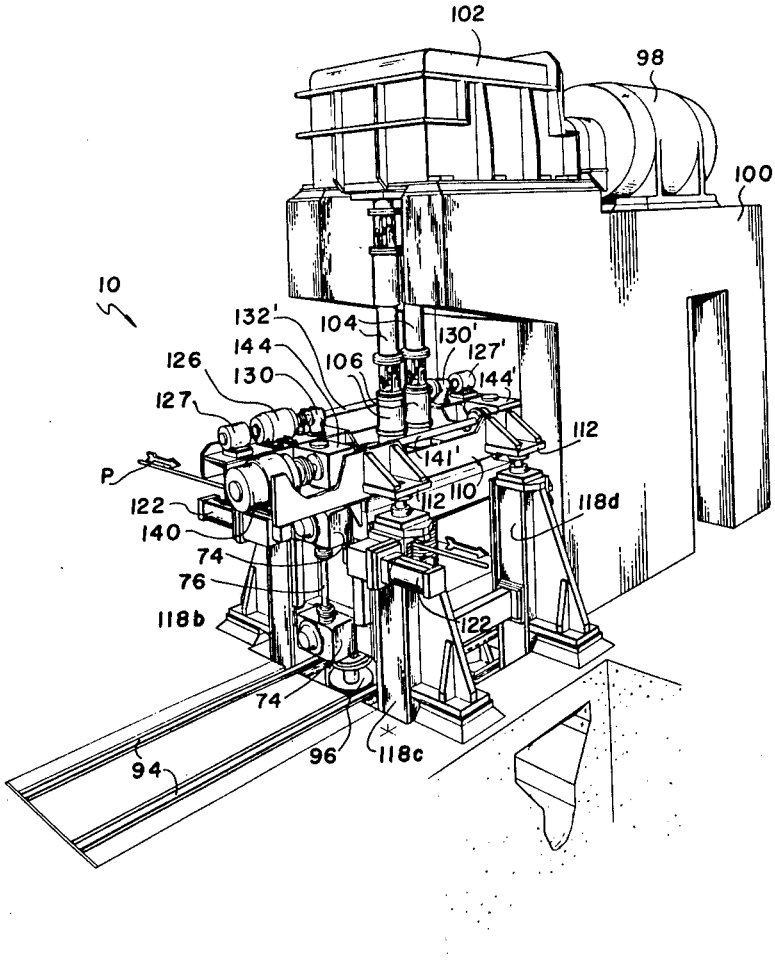
FIG. 1 is a view in perspective of a vertical bar mill roll stand embodying the concepts of the present invention, with the roll housing in its operative position on the rolling line.

Referring now to the drawings, a vertical roll stand embodying the concepts of the present invention is generally indicated at 10. The roll stand includes a pair of work rolls 12*a*, 12*b* each having a plurality of roll grooves 14 spaced axially along the surfaces thereof. The work rolls have upper roll necks with progressively reduced diameter sections 16*a–d*, and lower roll necks with reduced diameter sections 16*e–g*. The roll neck sections 16*a* and 16*e* are journalled respectively for rotation by means of upper and lower roller bearing assemblies 18, 18'. The roll neck sections 16*b* are additionally provided with thrust bearing assemblies 20. The roller and thrust bearing assemblies 18, 20 are contained in upper bearing chocks 22. The roller bearing assemblies 18' are contained in lower bearing chocks 24.

Figure 4:
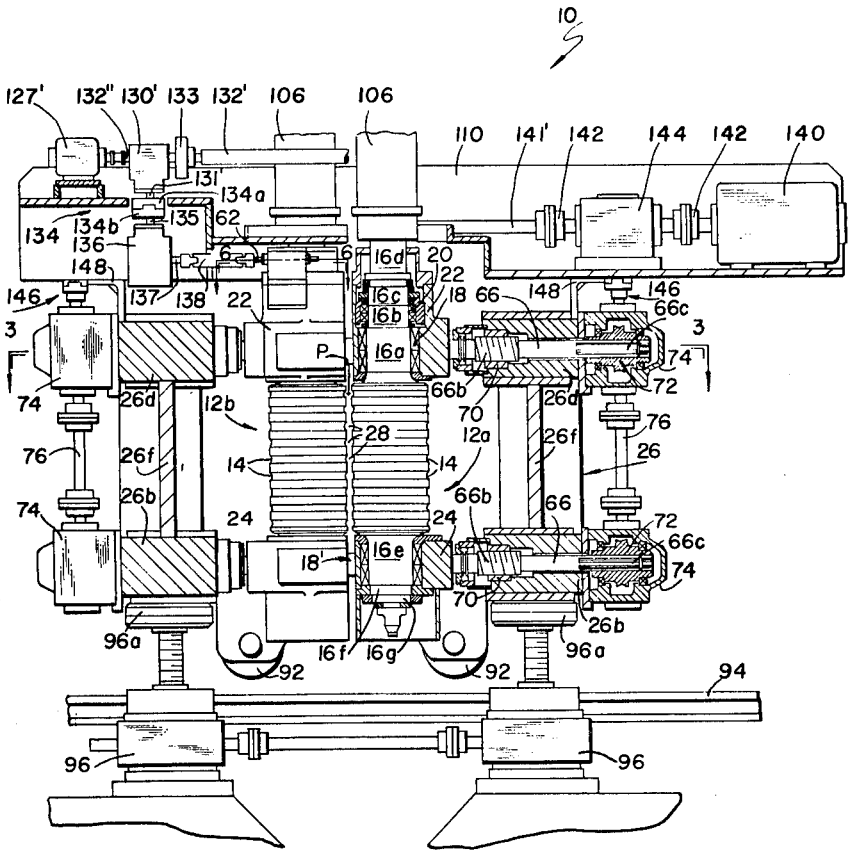
FIGS. 4 and 5 are sectional views taken along lines 4—4 and 5—5 of FIG. 3.

A roll housing 26 supports and contains the bearing chocks 22, 24 with the work rolls 12*a*, 12*b* in parallel relationship, and with the roll grooves 14 defining a plurality of roll passes 28, the top roll pass being in alignment with the mill pass line P when the roll housing is operatively positioned as shown in FIGS. 1 and 4. The roll housing may consist of a weldment of the following elements: integrally formed bottom side beams 26*a* and bottom end beams 26*b;* integrally formed top side beams 26*c* and top end beams 26*d* and connecting side plates 26*e* and end plates 26*f*.

Figure 7:
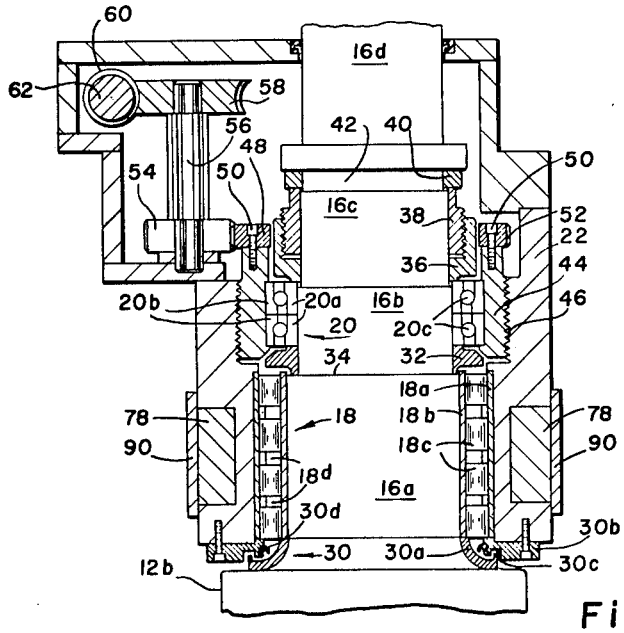
FIG. 7 is a sectional view taken along lines 7—7 of FIG. 6.
Figure 8:
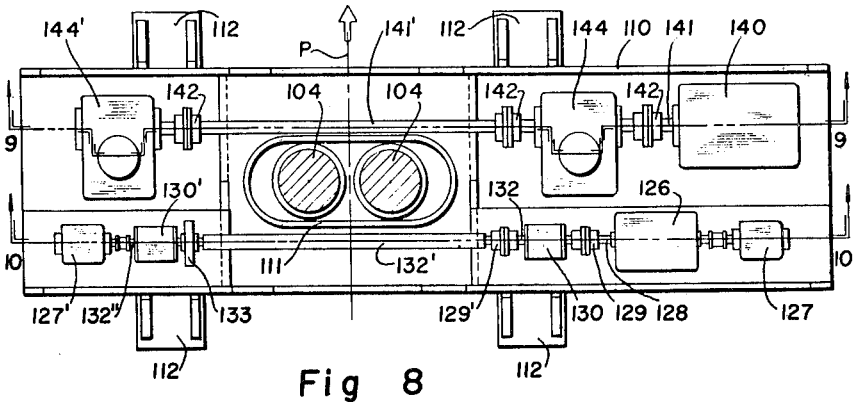
FIG. 8 is a horizontal section taken through the depending drive spindles and showing a plan view of the vertically adjustable platform.
Figure 9:
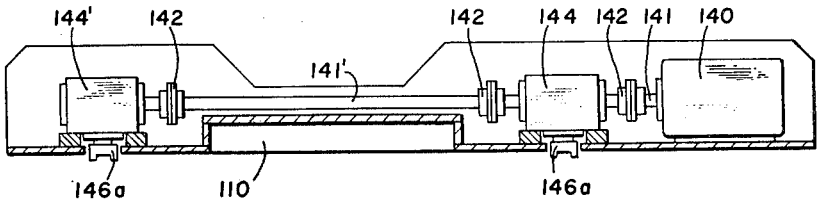
FIGS. 9 and 10 are sectional views taken along lines 9—9 and 10—10 of FIG. 8.

The roller bearing assemblies 18, 18' are adapted to accommodate axial adjustment of the work rolls 12*a*, 12*b* in relation to the bearing chocks 22, 24. To this end, and as can be best seen in FIG. 7, each roller bearing assembly 18, 18' comprises an outer race 18*a* fixed in relation to the bearing chock, an inner race 18*b* fixed axially in relation to the roll neck, the roller bearings 18*c* located between the inner and outer races. The roller bearings are spaced axially by spacers 18*d*, and are arranged such that axial movement on the order of ±0.002"–0.125" is possible between the inner and outer races 18*b*, 18*a*. A seal assembly 30 has inner and outer rigid components 30*a*, 30*b* axially spaced as at 30*c* to accommodate the aforesaid axial movement. The gap between the seal components 30*a*, 30*b* is bridged by a flexible seal element 30*d*.

The thrust bearing assemblies 20 comprise inner and outer races 20*a*, 20*b* with ball bearings 20*c* interposed therebetween. The inner thrust bearing races 20*a* are fixed in relation to the roll neck section 16*b* as follows: a lower neck ring 32 abuts a roll shoulder 34 and supports the lowermost inner thrust bearing race 20*a;* an internally threaded ring 36 on neck section 16*c* abuts the uppermost inner thrust bearing race 20*a;* the ring 36 is in threaded engagement with an externally threaded ring 38; ring 38 abuts a split ring 40 located in a groove 42 between the neck sections 16*c*, 16*d*.

The outer thrust bearing races 20*b* are fixed in relation to a generally cylindrical collar 44 threadedly engaged as at 46 within the upper bearing chock 22. The collar 44 forms part of an axial roll adjustment means, which additionally comprises a ring gear 48 fixed to the collar 44 as at 50. The ring gear 48 has external teeth 52 which mesh with a spur gear 54 on a shaft 56. The shaft 56 carries a worm wheel 58 rotatably driven by a worm 60 on the input shaft 62. Rotation of input shaft 62 imparts rotation to the threaded collar 44, which in turn operates through the thrust bearing assembly 20 to axially adjust the work roll. Although not shown, it is to be understood that an identical axial roll adjustment means is contained in the bearing chock 22 surrounding the upper roll neck of work roll 12*a*.

Figure 3:
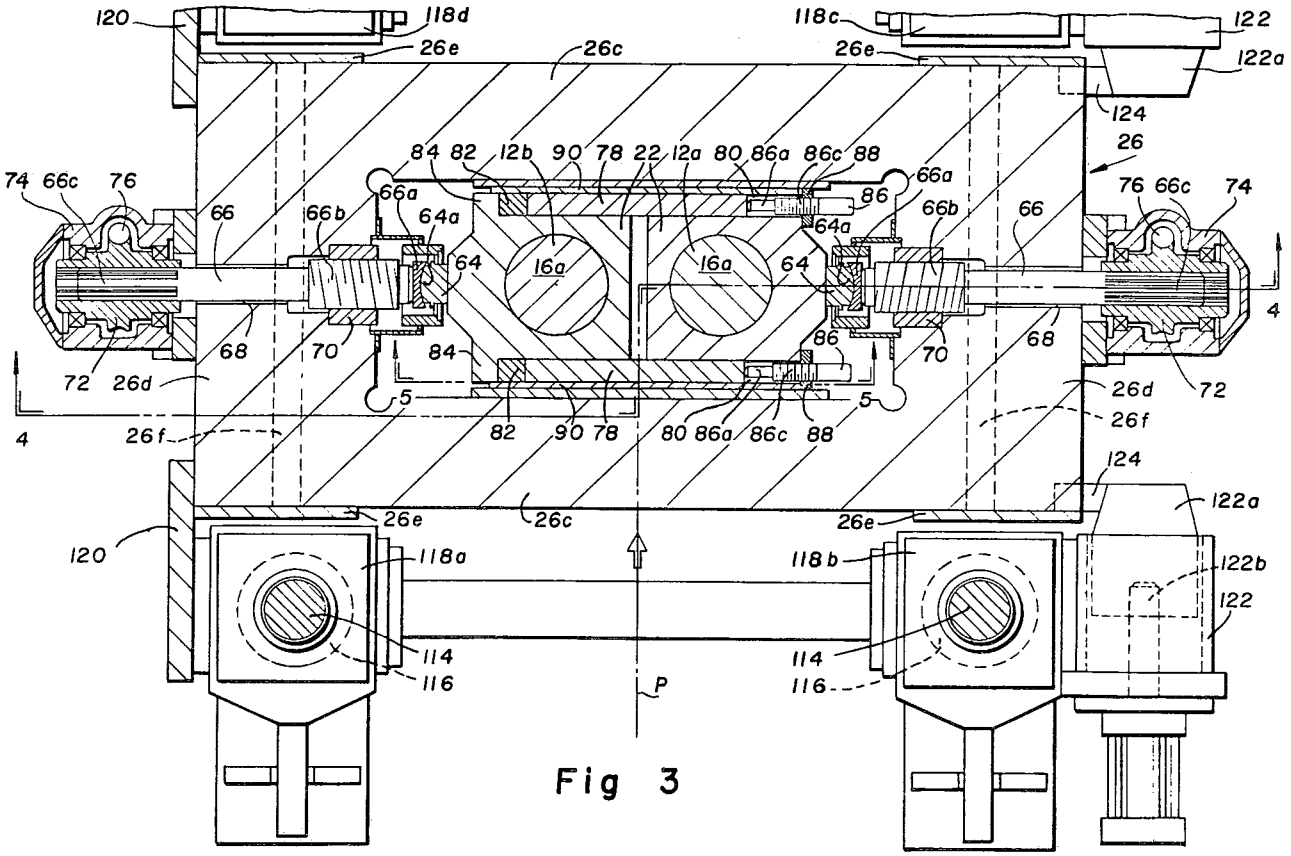
FIG. 3 is an enlarged horizontal sectional view taken through the roll housing at the level of the upper bearing chocks.
Figure 5:
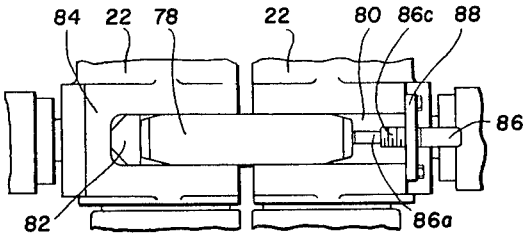

Parting adjustment means are associated with the upper and lower pairs of bearing chocks 22, 24 for imparting simultaneous lateral adjustments to the work rolls 12*a*, 12*b* in relation to the mill pass line P. As is best shown in FIGS. 3–5, the parting adjustment means includes a thrust element 64 bearing against each of the chocks. The thrust elements 64 have spherical heads 64*a* engaging spherical seats 66*a* on the ends of thrust shafts 66. The thrust shafts extend through openings 68 in the housing side beams 26*d*. The thrust shafts have threaded sections 66*b* engaging nuts 70 fixed to the housing side beams. The thrust shafts 66 also have splined sections 66*c* which extend axially through and which are rotationally fixed in relation to worm wheels 72 rotatably journalled in small sub-housings 74 mounted on the opposite ends of the roll housing 26. The worm wheels 72 are driven by worms on vertically extending input shafts 76.

The spherical heads 64*a* are held in their respective spherical seats 66*a* by thrust members 78 slidably received in grooves 80 in the sides of the bearing chocks 22, 24. Each thrust member 78 acts at one end of a thrust block 82 which in turn abuts a chock ear 84 forming the closed end of each groove 80. The opposite end of each thrust member is acted upon by the piston rod 86*a* of a ram assembly 86 threaded as at 86*c* into a nut 88 fixed to the chocks. The thrust members 78 and the thrust blocks 82 are held in their respective grooves 80 by cover plates 90. Extension of the piston rods 86*a* forces the bearing chocks 22, 24 apart and insures proper seating of the spherical heads 64*a* in their respective seats 66*a*. By simultaneously adjusting the rams 86 and rotating the thrust shafts 66, the roll parting can be adjusted either prior to or during operation of the mill.

Figure 2:
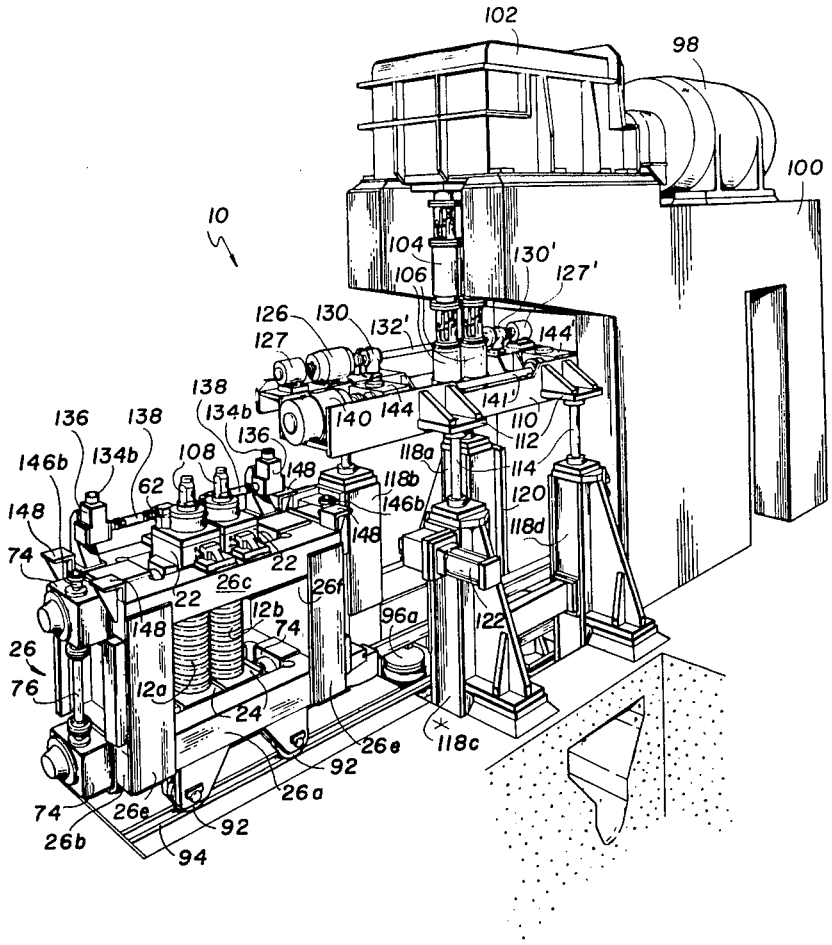
FIG. 2 is a perspective view similar to FIG. 1 showing the roll housing laterally removed from the rolling line.

The roll housing 26 is provided with wheels 92 arranged to run along tracks 94 extending laterally from the rolling line to a side position as shown in FIG. 2. After being shifted laterally onto the rolling line, the housing is elevated off the tracks 94 and supported vertically by housing adjustment means comprising heavy duty screw jacks 96 which have vertically adjustable noses 96*a* arranged to engage the bottom housing surfaces. The screw jacks 96 vertically adjust the position of the housing in the direction of the roll axes. When an active roll pass 28 becomes worn, the screw jacks may be operated to raise the housing so as to align the next lowermost roll pass with the mill pass line.

The work rolls 12*a*, 12*b* are driven by a mill drive which includes a motor 98 supported on an adjacent pedestal 100. Motor 98 is drivingly connected to a gear box 102 which has a pair of telescoping spindles 104 depending therefrom. The spindles have coupling boxes 106 at their lower ends with appropriately sized and dimensioned drive sockets which are axially inserted over the shaped roll ends 108. These shaped ends protrude vertically above the top of the roll housing 26 and the upper bearing chocks 22.

A platform 110 is located between the roll housing 26 and the overlying gear box 102. The platform has laterally extending feet 112 engageable by the underlying vertically disposed piston rods 114 of rams 116. The rams are contained within rugged stationary posts 118. As is best shown in FIG. 3, the posts 118*a*, 118*d* have stop plates 120 and the posts 118*b*, 118*c* carry rams 122 with tapered heads 122*a* on their piston rods 122*b*. The tapered heads 122*a* coact with oppositely inclined faces on housing shoes 124 to lock the housing 26 against the stop plates 120 during operation of the mill.

The platform 110 carries an axial adjustment drive which includes a motor 126 connected at one end to an indicator 127 which emits an electrical signal indicative of the axial roll adjustment resulting from rotation of output shaft 128. Output shaft 128 is connected via a coupling 129 to a right angle gear box 130 having a depending output shaft 131 and another output shaft 132 aligned axially with shaft 128. Shaft 132 is connected via coupling 129', shaft extension 132' and magnetic clutch 133 to another right angle gear box 130'. Gear box 130' has a depending output shaft 131' and another output shaft 132'' connected to an indicator 127'. Indicator 127' also emits an electrical signal indicative of the axial roll adjustment resulting from rotation of shaft 132''. The depending output shafts 131, 131' each carry halves 134*a* of axially separable coupling assemblies 134 (one shown in FIG. 4). The other halves 134*b* of the coupling assemblies 134 are carried on the upper ends of the input shafts 135 of right angle gear boxes 136. The output shafts 137 of the gear boxes 136 are connected via disconnectable intermediate drive shafts 138 to the input shafts 62 of the axial adjustment means associated with each roll shaft.

The platform 110 also carries a roll parting adjustment drive including a motor 140 with an output shaft 141 connected via couplings 142 and an output shaft extension 141' to two right angle gear boxes 144, 144'. Each of these gear boxes has a depending output shaft carrying half 146*a* of an axially separable coupling assembly 146, the other half 146*b* being carried on the top end of each shaft 76.

Figure 12:
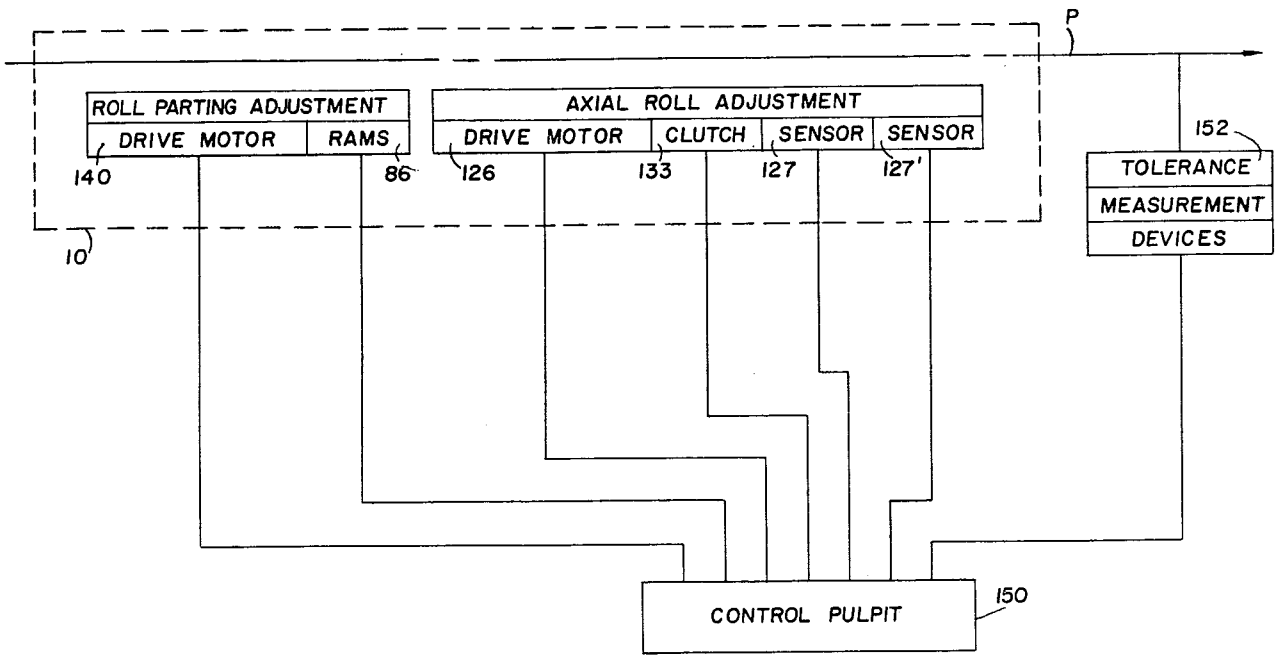

As shown schematically in FIG. 12, the roll parting adjustment drive motor 140 and the axial adjustment drive motor 126, clutch 133 and sensors 127, 127' are all electrically connected to a central control pulpit 150 which is located remotely from the rolling line, and which also receives signals from conventional product tolerance measuring devices 152. These components may be monitored and/or controlled either automatically or manually at the control pulpit.

The above-described apparatus operates in the following manner; beginning with the equipment at the stage illustrated in FIG. 2, it will be seen that the platform 110 has been adjusted to its raised inoperative position on the piston rods 114 of the rams 116. The roll housing 26 is located to one side of the mill pass line P with a fresh set of work rolls 12*a*, 12*b* mounted therein.

The housing 26 is them moved on its wheels 92 along tracks 94 to a position underlying the platform 110. At this stage, the coupling halves 134*b* and 146*b* are spaced beneath and aligned axially with their mating coupling halves 134*a*, 146*a*. The screw jacks 96 are then operated to lift the housing 26 off of the tracks 94 in a direction parallel to the roll axes in order to align the uppermost roll pass 28 with the mill pass line P. The rams 116 are also actuated to retract the piston rods 114, thereby lowering the platform 110. As this occurs, the mating halves of the coupling assemblies 134, 146 are axially connected. The platform 110 is eventually received on and thereafter supported by shelves 148 on the housing. Also, the shaped roll ends 108 are inserted into the drive sockets of the coupling boxes 106 at the lower ends of the depending drive spindles 104. This having been accomplished, the rams 122 are actuated to advance the tapered noses 122*a* into engagement with the housing shoes 124. This in turn wedges the housing 26 against the stop plates 120 and thus fixes the housing in an operative position confined between the posts 118*a*–*b*. Rolling then commences.

Figures 11A, 11B, 11C:
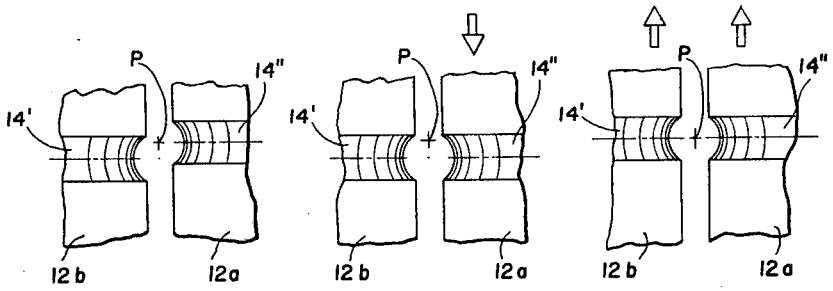
FIGS. 11A–11C are schematic views depicting the operation of the axial adjustment means, with the groove misalignments having been exaggerated for purposes of illustration; and, FIG. 12 is a schematic control diagram.
Figure 6:
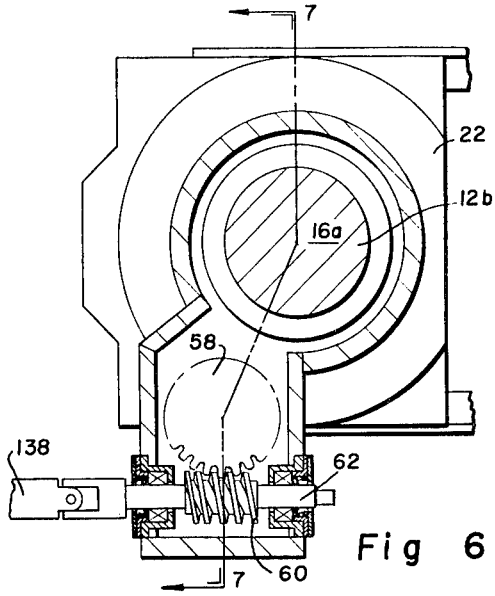
FIG. 6 is an enlarged sectional view taken along lines 6—6 of FIG. 4.

Thereafter, if required, "fine" axial roll adjustments on the order of ±0.002–0.125" may be made in order to achieve a more precise alignment of the active roll grooves with each other, or of the active roll pass with the mill pass line. For example, and as shown in FIG. 11A, it is conceivable that after axially shifting the roll housing as described above, a roll groove 14' of the work roll 12*b* might have its groove centerline below the mill pass line, whereas the roll groove 14'' of work roll 12*a* might have its centerline properly aligned. This type of groove misalignment will produce tolerance deviations which will immediately be sensed by the measuring devices 152. The necessary axial roll adjustments are achieved with the present invention by first disengaging the clutch 133 and thereafter operating the motor 126 to axially adjust only work roll 12*a* in a downward direction as shown in FIG. 11B. This downward adjustment will place the centerline of groove 14" in horizontal alignment with the centerline of groove 14'. Thereafter, the clutch 133 will be engaged and both work rolls 12*b*, 12*a* will be moved axially upwardly as shown in FIG. 11C in order to bring the centerlines of grooves 14', 14" into horizontal alignment with the mill pass line P. As previously noted, both motor 126 and clutch 133 can be operated remotely at pulpit 150, where the output signals of sensors 127, 127' and the tolerance measuring devices 152 are also received.

The roll parting can also be adjusted remotely by operating drive motor 140 to rotate the thrust shafts 66 while simultaneously making appropriate adjustments to the compensating ram assemblies 86. All of these adjustments can be performed while the housing 26 remains fixed in its operative position. When the active roll pass becomes worn, rolling is interrupted briefly in order to change to another roll pass. This is accomplished by actuating the rams 122 in order to withdraw the tapered heads 122*a*. This frees the housing 26 for vertical adjustment in an upward direction by the screw jacks 96. The housing is raised sufficiently to align a fresh roll pass with the mill pass line, and the rams 122 are again actuated to lock the housing in place. The drive spindles telescope axially during upward movement of the roll housing 26 and the platform 110. Thereafter, fine adjustments are again made to the work rolls as described above while the rolling operation continues.

Figure 10:
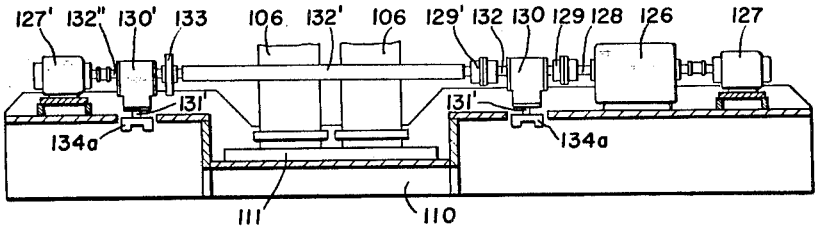

When all of the roll grooves have been used, the rams 122 are actuated to free the housing. The screw jacks 96 then return the housing to its lowermost position with the wheels 92 supported on the tracks 94. As the housing drops to this lowermost position, the piston rods 114 of rams 116 are extended. Platform 110 is thus again supported on the piston rods 114 with the result that the couplings 134, 146 are again axially disconnected, thereby freeing the axial adjustment drive and roll parting adjustment drive from the axial adjustment means and roll parting adjustment means. At the same time, as the upper ends of the roll shafts are axially lowered, they drop away from the coupling boxes 106 which (see FIG. 10) are being engaged and vertically displaced by a shelf 111 on the platform 110. The housing is then shifted to the position shown in FIG. 2 and a change of work rolls is accomplished.

In light of the foregoing, it will now be appreciated by those skilled in the art that the means described for axially adjusting the work rolls, as depicted for example in FIGS. 11A–11C, is applicable to both horizontal and vertical roll stands. However, the use of a platform 110 and the described advantages associated therewith, is limited to vertical roll stands.

It is our intention to cover all changes and modifications of the embodiment herein chosen for purposes of disclosure which do not depart from the spirit and scope of the invention as claimed.

We claim:

1. A roll stand for a rod or bar rolling mill comprising: a pair of work rolls having a plurality of grooves spaced axially along the surfaces thereof, each work roll being journalled between bearings contained in bearing chocks; a housing for supporting said bearing chocks with said work rolls in parallel relationship and with said grooves defining a plurality of roll passes, said bearings being adapted to accommodate axial adjustment of said work rolls in relation to said bearing chocks; an axial adjustment means associated with one bearing chock of each work roll for imparting said axial roll adjustments; an axial adjustment drive connected to the axial adjustment means of both said work rolls; and clutch means connected between said axial adjustment drive and one of said axial adjustment means, said clutch means being operable when engaged to permit said axial adjustment drive to operate through both axial adjustment means, and when disengaged to permit said axial adjustment drive to operate through only one axial adjustment means.

2. The roll stand of claim 1 further comprising a parting adjustment means associated with each work roll for imparting lateral adjustments thereto; and a parting adjustment drive connected to both said parting adjustment means, said parting adjustment drive being operative through said parting adjustment means to simultaneously adjust the work rolls laterally in opposite directions in relation to the mill pass line.

3. The roll stand of claims 1 or 2 further comprising support means for locating said housing along the rolling line, and housing adjustment means associated with said support means for moving the housing in the direction of the roll axes in order to align the roll passes with the mill pass line.

4. The roll stand of claim 3 wherein said work rolls are vertically disposed, with the upper ends of said work rolls protruding vertically above the uppermost bearing chocks, and telescoping spindle means depending vertically from an overlying mill drive for driving said work rolls, said spindle means being detachably connected to the upper ends of said work rolls by vertically removable coupling boxes.

5. The roll stand of claim 4 further comprising a platform located between said housing and said mill drive, said axial adjustment drive and said parting adjustment drive being carried on said platform, coupling means for providing a drive connection between each of said drives and the adjustment means associated therewith, and elevating means for moving said platform vertically between a lowered operative position supported on said housing and a raised inoperative position spaced thereabove, said coupling means being axially separable in response to vertical movement of said platform from said lowered operative position to said raised inoperative position.

6. The roll stand of claim 5 wherein said elevating means is comprised of vertically arranged stationary piston-cylinder units, each of said units having a vertically axially movable piston rod which is positioned to engage said platform.

7. The roll stand of claim 5 further comprising means on said platform for engaging and vertically displacing said coupling boxes during vertical movement of said platform in response to operation of said elevating means, whereupon said coupling boxes are engaged with the upper roll ends when said platform is in its lowered operative position, and said coupling boxes are disengaged from and supported above the upper roll ends on said platform when said platform is in the raised inoperative position.

8. The roll stand of claim 1 further comprising sensing means associated with said axial adjustment drive for generating electrical control signals indicative of the axial adjustments being imparted to said work rolls.

9. The roll stand of claim 8 wherein said axial adjustment drive and said clutch means are electrically operable from a location remote from said housing.

* * * * *